United States Patent [19]

Rogers

[11] 4,258,884

[45] Mar. 31, 1981

[54] NOZZLE EXTENSION SYSTEM FOR CAULKING GUN

[76] Inventor: David L. Rogers, 501 Munroe Cir., Glen Burnie, Md. 21061

[21] Appl. No.: 971,552

[22] Filed: Dec. 20, 1978

[51] Int. Cl.[3] ..... B65D 35/38

[52] U.S. Cl. ..... 239/390; 222/570; 285/DIG. 22

[58] Field of Search ..... 222/325-327, 222/566, 567, 570, 568; 285/DIG. 22, 260; 239/390, 391, 397

[56] References Cited

U.S. PATENT DOCUMENTS

| | | | |
|---|---|---|---|
| 490,956 | 1/1893 | Franzen | 239/391 X |
| 2,330,034 | 9/1943 | Doodchenko | 239/391 X |
| 2,754,033 | 7/1956 | Etter | 222/326 |
| 2,953,285 | 9/1960 | McKelvey | 222/325 X |
| 3,391,705 | 7/1968 | Halpert | 285/260 X |
| 3,667,785 | 6/1972 | Kapeker | 285/DIG. 22 X |
| 3,938,709 | 2/1976 | Collar | 222/325 X |

*Primary Examiner*—Andres Kashnikow
*Attorney, Agent, or Firm*—Walter G. Finch

[57] ABSTRACT

The invention is a system of a plurality of extensions for a nozzle on dispensing cans or cartridges of various materials, as for example a cartridge of caulking compound. The normal nozzle on a container of material is usually very short and is useless in confined areas where the point of application is beyond the reach of the existing nozzle. The present invention provides a series of interlocking extensions which can be added to the short nozzle on the cartridge to reach the point of application at a range of distance.

9 Claims, 8 Drawing Figures

NOZZLE EXTENSION SYSTEM FOR CAULKING GUN

BACKGROUND AND SUMMARY OF THE INVENTION

The invention relates to dispensing cans, cartridges, and similar containers of various materials, and in particular to such cans, cartridges, and similar containers which have a nozzle or tube-like projection at one end through which the material is applied to a specific point. Specifically, the invention applies to containers of such materials such as caulking compounds and the like.

A need has existed for a long time for a means of making it possible to reach points that are more of less inaccessible when applying a material, such as a caulking compound, from a container, such as a can or cartridge or the like.

The invention is intended for use on those type containers which dispense the material through a spout or nozzle-like fixture on the container.

The invention consists of a plurality of nozzle-like extensions which may be straight or curved and which fit on to each other and the first of which fits on the normal existing nozzle on the container of material involved. The nozzle-like extensions are reusable.

A first extension piece is added to the nozzle existing on the container to provide an initial added distance that can be reached for dispensing the material.

A second extension piece is added to the first extension piece, and has a snap-fit to hold it in place, to add additional lengths to reach a confined or rather inaccessible dispensing point.

A third extension piece is provided to be added to the second extension piece, with a snap-fit connection, to provide an even greater length to reach more or less inaccessible points for dispensing material from the container.

It is to be understood that although only three units are depicted in this invention, any number of extension pieces may be provided (similar to the second piece noted hereinbefore) to provide additional length to reach distant points. Such additional extensions are within the scope and intent of this invention.

It is also to be understood that although caulking compound has been cited as one material which is dispensed from containers and which could utilized this invention, any material that is supplied in such containers and dispensed through nozzle-like means is within the scope and intent of this invention.

It is, therefore, an object of this invention to provide a means for extending nozzle-like dispensing means on cans, cartridges, and similar containers of materials.

It is also an object of this invention to provide a plurality of nozzle-like extension means that fit on to each other for providing a range of extensions for the nozzle-like dispensing means on cans, cartridges, and similar containers of materials.

It is another object of this invention to provide a plurality of extension means that have snap-fit connections with each other to assure rigidity and control of the nozzle portion when in use.

It is still another object of this invention to provide nozzle-like extensions that are reusable.

It is yet another object of this invention to provide a nozzle-like extension that may be straight or curved to reach more or less inaccessible points of application for the material.

Further objects and advantages of the invention will become more apparent in the light of the following description of the preferred embodiments.

DESCRIPTION OF THE PREFERRED EMBODIMENTS

Figure 1:
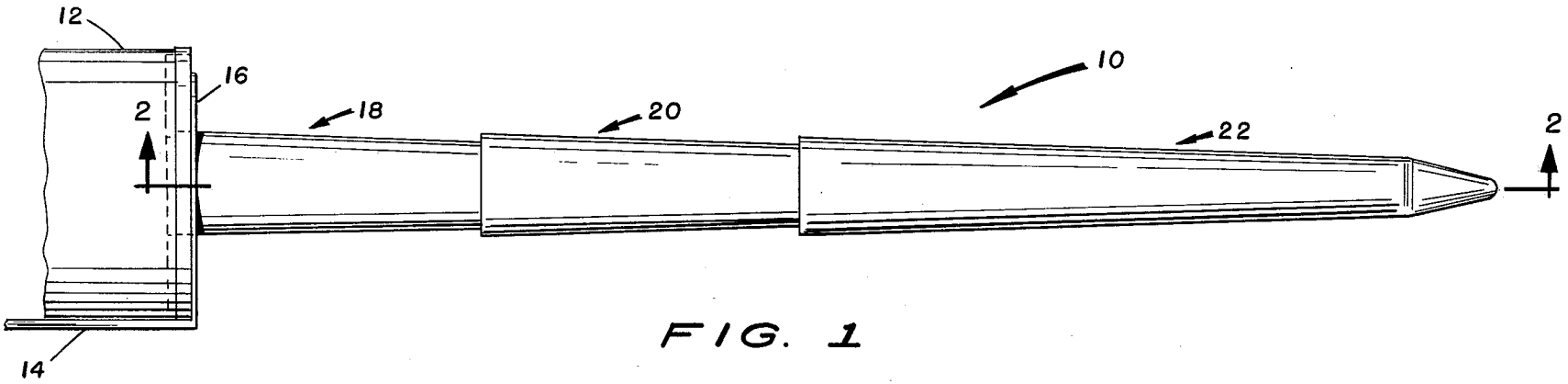
FIG. 1 is a side view of an assembly of a nozzle extension system.
Figure 2:
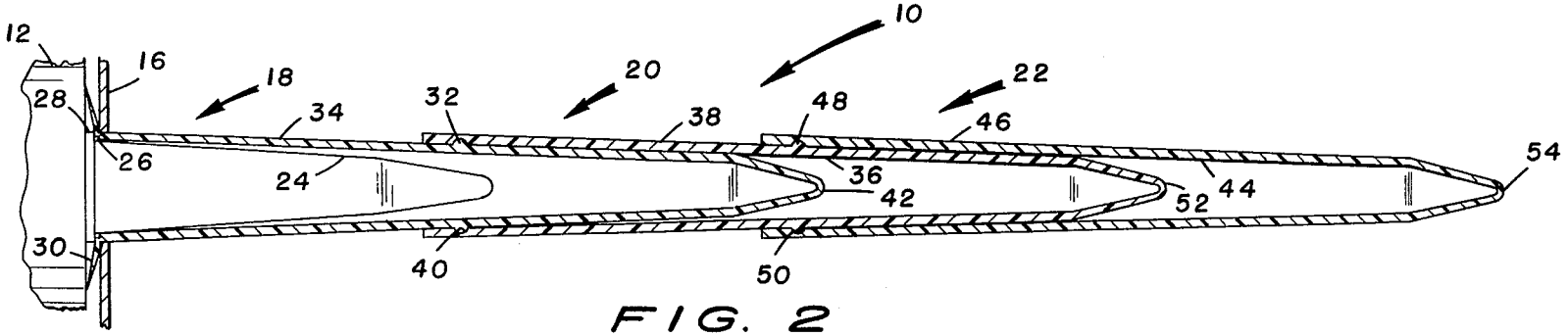
FIG. 2 is a sectional view on line 2—2 of FIG. 1.
Figure 3:
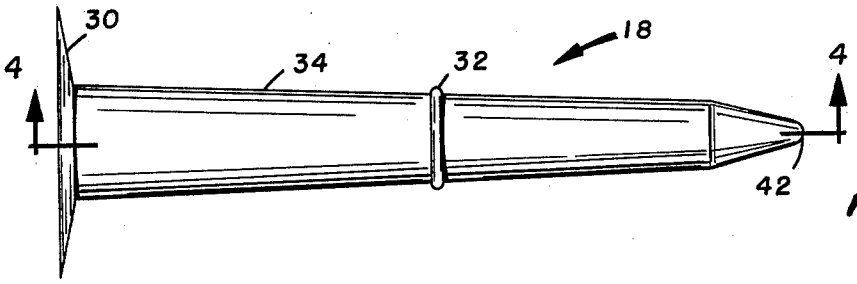
FIG. 3 is a sideview of a first unit nozzle extension.
Figure 4:
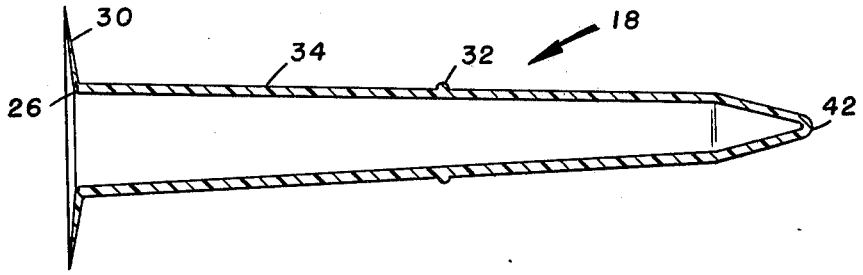
FIG. 4 is a sectional view on line 4—4 of FIG. 3.

Referring to the drawings and particularly to FIGS. 1 and 2, an improved nozzle extension system is shown at 10.

As can be seen in FIGS. 1 and 2, the nozzle extension system consists of three separate extension means, namely, a first or container end extension means 18, a second or intermediate extension means 20, and a third or end extension means 22.

It is to be understood that although only three extension means are depicted in FIG. 1, a greater plurality of extension means may be used by inserting additional intermediate extension means 20. Such an increase in the plurality of extension means is within the scope and intent of the invention.

It is also to be noted that although extension means 18, 20, and 22 are shown in a straight configuration, they may also be curved in order to reach around objects to reach more or less inaccessible points for the application of materials. Such a variation in the configuration is within the scope and intent of the invention.

It is to be noted that all extension means (18, 20, and 22) are circular-like in cross section at any point though not shown in the drawings.

The use of the first extension means 18 is the first embodiment of the system, the use of the first extension means 18 and the second extension means 20 (in combination) is the second embodiment of the system, and the use of the first extension means 18, the second extension means 20, and the third extension means 22 (in combination) is the third embodiment of the invention.

Turning now to FIGS. 1, 2, 3, and 4, the first or container end extension means 18 is shown with a flange 30 on the main open end. This flange 30 fits against the end of the container 12 when the extension means 18 is slipped over the dispensing spout or nozzle 24 on the container 12.

The holding arm 14 of a dispensing container holder (such a caulking "gun" for containers of caulking compound) is shown in FIG. 1 with the holding fingers 16 clamping across the flange 30 of the extension means 18 to hold the extension means 18 tightly in place over the dispensing nozzle 24 and against the end of the container 12. The holding fingers 16 clamp the extension means 18 tightly against container 12 when the dispensing mechanism (not shown) is operated. Thus, extension means 18 provides a greater length to the nozzle 24.

It is to be understood that the configuration of the dispensing mechanism and its holding arm 14 and holding fingers 16 may vary on different units, but the dispensing mechanism and its parts are not part of this invention. The holding devices on the mechanisms are essentially the same and any variation is within the scope and intent of this invention.

The flange 30 is shown with a recess 26 which serves to provide a seal-like contact when pressed against the end of the container 12.

Most containers 12 have a small raised lip or protrusion 28 on the end where the nozzle 24 is located. The recess 26 in the flange 30 in combination with the lip 28 serves to provide a better seal of the nozzle extension 18 against the container 12.

Nozzle extension means 18 has conical-like walls 34 extending outward from the flange 30, the open center of the flange 30 communicating with the interior of the conical-like interior of the conical-like walls 34. The conical-like walls 34 form into a rounded tip 42 at the conical end of the conical-like walls 34.

A raised bead or lip 32 encircles the conical-like walls 34 of nozzle extension 18. As will be seen hereinafter, this raised bead or lip 32 will mate with a groove 40 inside the intermediate extension means 20.

In normal use, the spout or nozzle 24 on the container is snipped or cut off so that the material in the container can be forced out through the nozzle 24 end to the point of application. In a like manner, the rounded end 42 of the first extension means 18 is also snipped or cut off so that the material in the container 12 can be forced out of the nozzle extension means 18 to the point of application, as nozzle 24 communicates with extension means 18 through the cut off end of nozzle 24.

It is to be noted that the rounded end 42 could be formed with an opening, as could also be done for the hereinafter described rounded end 52 of extension means 20, and the rounded end 54 of the extension means 22. Such a variation is within the scope and intent of this invention. However, the rounded ends 42, 52, and 54 are not shown with an opening so that the rounded ends 42, 52, and 54 may be cut off straight across, on a bias, merely pierced, or cut in any other configuration to suit the job to be done in dispensing the material in the container 12, in order to accomodate the configuration to which the nozzle end is addressed.

As noted hereinbefore, the extension means 18, and extension means 20 and 22 may be curved in order to reach or extent around obstructions in order to dispense material in container 12. Such a variation is within the scope and intent of this invention.

Figure 5:
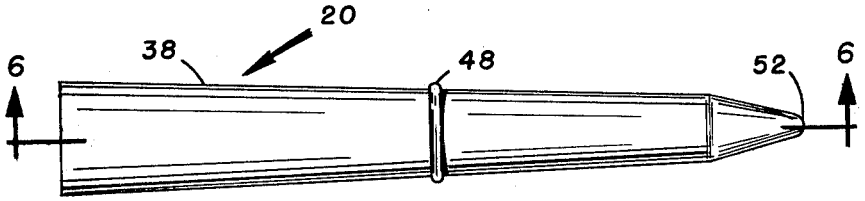
FIG. 5 is a side view of a second unit nozzle extension.
Figure 6:
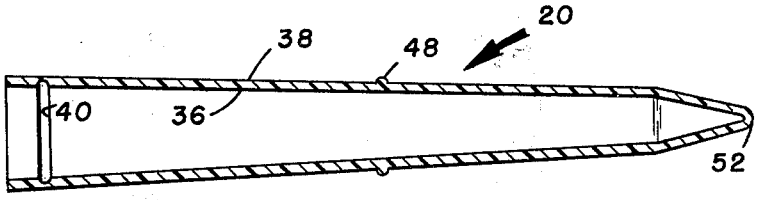
FIG. 6 is a sectional view on line 6—6 of FIG. 5.

Turning now to FIGS. 5 and 6 for the intermediate extension means 20, it consists of conical-like walls 38, having a conical-like interior, a groove 40 encircling the interior wall which mates with and snaps over the rib 32 encircling the first extension means 18, thus locking extension means 18 and 20 together tightly. The interior wall surface 36 of the conical-like wall 38 of the intermediate extension means 20 have the same conical slope as the exterior wall surface of walls 34 of the container end extension means 18, thus interfacing with each other as the groove 40 snaps into place over rib 32.

The intermediate extension means 20 has a rib 48 encircling the conical-like walls 38 which will mate with groove 50 in the end extension means 22 as hereinafter described. A rounded tip 52 is at the end of the conical end of intermediate extension means 20.

When the tip 42 of container end extension means 18 is cut off, the interior of container end extension means 18 communicates with the interior of intermediate extension means 20 when the two extension means 18 and 20 are connected to each other. Thus nozzle 24, and extension means 18 and 20 communicate with each other through the cut off tips. The coupling of intermediate extension means 20 to container end extension means 18 further extends the original nozzle 24 for reaching inaccessible points for dispensing material from container 12.

Figure 7:
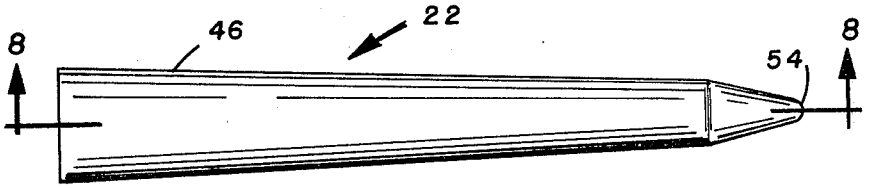
FIG. 7 is a side view of a third unit nozzle extension.
Figure 8:
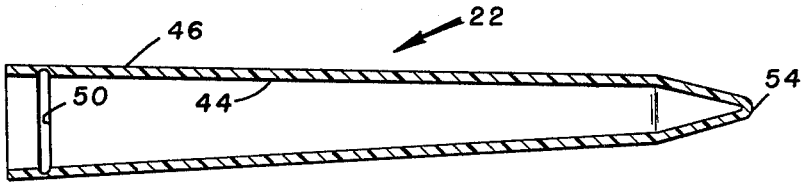
FIG. 8 is a sectional view on line 8—8 of FIG. 7.

In a like manner in FIGS. 7 and 8, the end extension means 22 has conical-like walls 46 that end in a rounded tip 54 on the conical end. Groove 50 mates with and snaps over rib 48 of intermediate extension means 20 to form a rigid connection. Also, in a like manner, the interior wall surface 44 of the conical-like walls 46 of the end extension means 22 have the same slope as and interface with the exterior of the conical-like walls 38 of the intermediate extension means 20.

The interior of end extension means 22 communicates with the interior of intermediate extension means 20 through the cut off end of the intermediate extension means 20 at the rounded tip 52. Thus a further extension to nozzle 24 is provided. Dispensing of material is performed by cutting off the rounded end 54 as hereinbefore described for other extension means 18 and 20.

As noted hereinbefore, additional extension can be accomplished by inserting additional intermediate extension means 20 in the system of extension means 10.

It is also to be noted that although the present invention has been shown as having a circular cross section, it is within the scope and intent that the cross section may be any other geometrical configuration.

The extension means 18, 20 and 22 may be of any material or color that has a flexibility that will permit the snap on connections, such as a plastics material.

There is an additional use for the extension means, particularly one which does not have the end cut off. An extension means may be used as a cap on the end to keep material from leaking from the container or to keep the material in a nozzle or extension from hardening by exposure to air.

Accordingly, modifications and variations to which the invention is susceptible may be practiced without departing from the scope and intent of the appended claims.

What is claimed is:

1. A nozzle extension system for dispensing-type containers of material, comprising:

a plurality of conical-like nozzle extension means, each said conical-like nozzle means having a first end and a second end, said first end of each said conical-like nozzle means being the conical end and said second end of each said conical-like nozzle means being the open end of said conical-like nozzle means, said first end of each said conical-like nozzle means being slidably insertable into said second end of another said conical-like nozzle means; and an external rib and an internal groove, said external rib being on the outside of each said conical-like nozzle extension means except one which is the last of said plurality of conical-like nozzle extension means, said internal groove being on the inside of each said conical-like nozzle extension means except one which is the first of said plurality of conical-like extension, each said external rib and each said internal groove being integrally formed and monolithic with each said conical-like extension means to which applied, said external rib of one said conical-like extension means mating with said internal groove of another said conical-like extension means when said first end of one conical-like nozzle means is slidably inserted into said second end of another said conical-like nozzle means for removably connecting together said plurality of conical-like nozzle extensions when slidably and removably assembling said conical-like nozzle extensions to each other in a rigid manner.

2. A nozzle extension system as recited in claim 1, wherein said plurality of conical-like nozzle extension means consists of:

a first nozzle extension means;

one or more second nozzle extension means, one of said second nozzle extension means being connected to said first nozzle extension means, other said second nozzle extension means when present being successively connected to first of said second nozzle extension means and to each other;

a third nozzle extension means, said third nozzle extension means being connected to most distal of said second nozzle extension means.

3. A nozzle extension system as recited in claim 2, wherein said first nozzle extension means consists of a hollow conical-like body, said conical-like body being closed at the apex and open at the base, said first nozzle extension means having a flange encircling the base, said flange being integrally formed and monolithic with said hollow conical-like body.

4. A nozzle extension system as recited in claim 3, wherein said second nozzle extension means consists of a hollow conical-like body, said conical-like body being closed at the apex and open at the base.

5. A nozzle extension system as recited in claim 4, wherein said third nozzle extension means consists of a hollow conical-like body, said conical-like body being closed at the apex and open at the base.

6. A nozzle extension system as recited in claim 5, wherein the slope of the external face of said second nozzle extension means and the slope of the internal face of said third nozzle extension means are the same so that said faces interface when nested during assembly, said external rib of said second nozzle extension means mating with said internal groove of said third nozzle extension means in a snap fit.

7. A nozzle extension system as recited in claim 4, wherein the slope of the external face of said first nozzle extension means and the slope of the internal face of said second nozzle extension means are the same so that said faces interface when nested during assembly said external rib of said first nozzle extension means mating with said internal groove of said second nozzle extension means in a snap fit.

8. A nozzle extension system as recited in claim 4, wherein the slopes of the external face and the internal face of said second nozzle extension means are the same, and are parallel and concentric so that a plurality of said second nozzle extension means may be nested during assembly and have said faces interface, and said external rib of one said second nozzle extension means mating with said internal groove of the next said second nozzle extension means in a snap fit.

9. A nozzle extension system as recited in claim 1, wherein each said conical-like nozzle extension means is of conical configuration along a longitudinal axis with a straight centerline.

* * * * *